US007568861B2

(12) United States Patent
Godøy et al.

(10) Patent No.: US 7,568,861 B2
(45) Date of Patent: Aug. 4, 2009

(54) BEND STIFFENER

(75) Inventors: Erik Godøy, Lillesand (NO); Jan Egeland, Stavanger (NO)

(73) Assignee: Marine Subsea Group AS, Andalsnes (NO)

( * ) Notice: Subject to any disclaimer, the term of this patent is extended or adjusted under 35 U.S.C. 154(b) by 62 days.

(21) Appl. No.: 11/575,532

(22) PCT Filed: Sep. 19, 2005

(86) PCT No.: PCT/NO2005/000345

§ 371 (c)(1),
(2), (4) Date: Aug. 29, 2007

(87) PCT Pub. No.: WO2006/033579

PCT Pub. Date: Mar. 30, 2006

(65) Prior Publication Data

US 2007/0292214 A1 Dec. 20, 2007
US 2009/0080982 A9 Mar. 26, 2009

(30) Foreign Application Priority Data

Sep. 23, 2004 (NO) ..... 20043980

(51) Int. Cl.
*E21B 17/01* (2006.01)

(52) U.S. Cl. ..... 405/211; 166/367; 138/106

(58) Field of Classification Search ..... 405/195.1, 405/211, 216; 166/350, 367; 138/106, 170, 138/172

See application file for complete search history.

(56) References Cited

U.S. PATENT DOCUMENTS

| | | | | |
|---|---|---|---|---|
| 3,252,192 | A | 5/1966 | Smith | |
| 4,363,567 | A | 12/1982 | Van der Graaf | |
| 4,635,970 | A * | 1/1987 | Haines | 285/114 |
| 5,161,828 | A | 11/1992 | Hynes et al. | |
| 5,439,323 | A | 8/1995 | Nance | |
| 6,561,714 | B1 * | 5/2003 | Williams et al. | 403/2 |

FOREIGN PATENT DOCUMENTS

| | | |
|---|---|---|
| GB | 2 291 686 | 1/1996 |
| WO | 98/41729 | 9/1998 |

* cited by examiner

*Primary Examiner*—Tara Mayo-Pinnock
(74) *Attorney, Agent, or Firm*—Volpe & Koenig, P.C.

(57) ABSTRACT

A bend stiffener to surround an end portion of an elongated, essentially cylindrical object, e.g. a flexible pipe or a cable, extending from a subsea installation to a surface vessel, and is connected to an end piece or end flange of the object at a connection to the vessel. A plurality of spaced apart clamp sets, each set has inner, essentially cylindrical clamp surrounding the object and semi-circular longitudinal grooves for receiving spring rods in an outer surface thereof, and outer clamp which in inner surface thereof has longitudinal semi-circular grooves for receiving the spring rods. The spring rods are secured in the end piece or the end flange or an adapted arrangement on the object. Each outer clamp is secured to the respective inner clamp and locks the spring rods relative to the inner clamp and the object.

12 Claims, 3 Drawing Sheets

Fig 2
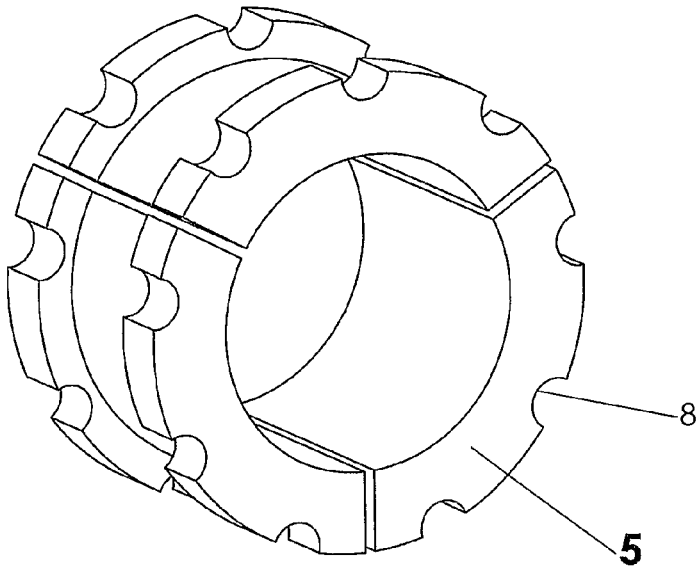
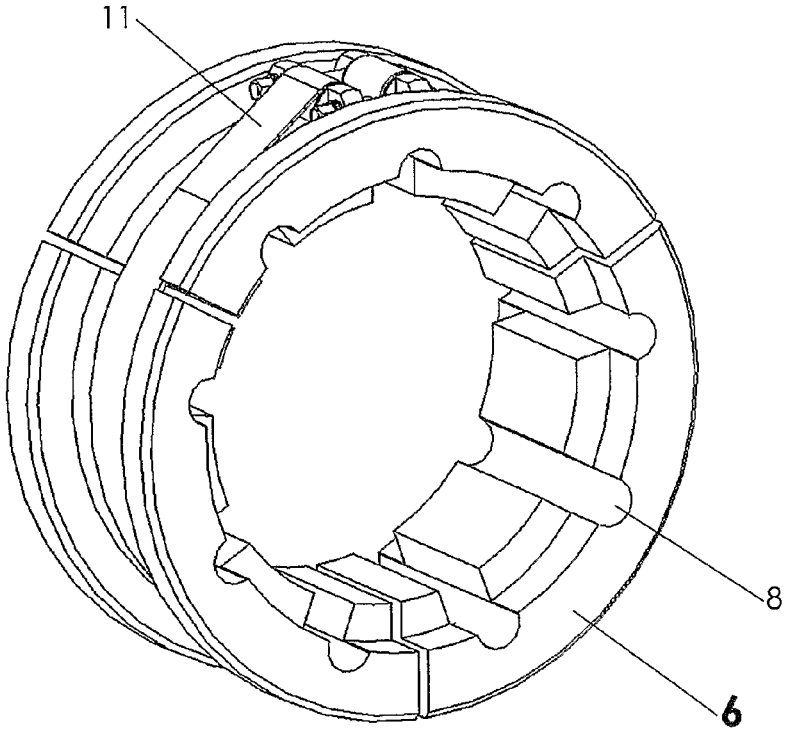
Fig 3

Fig 4
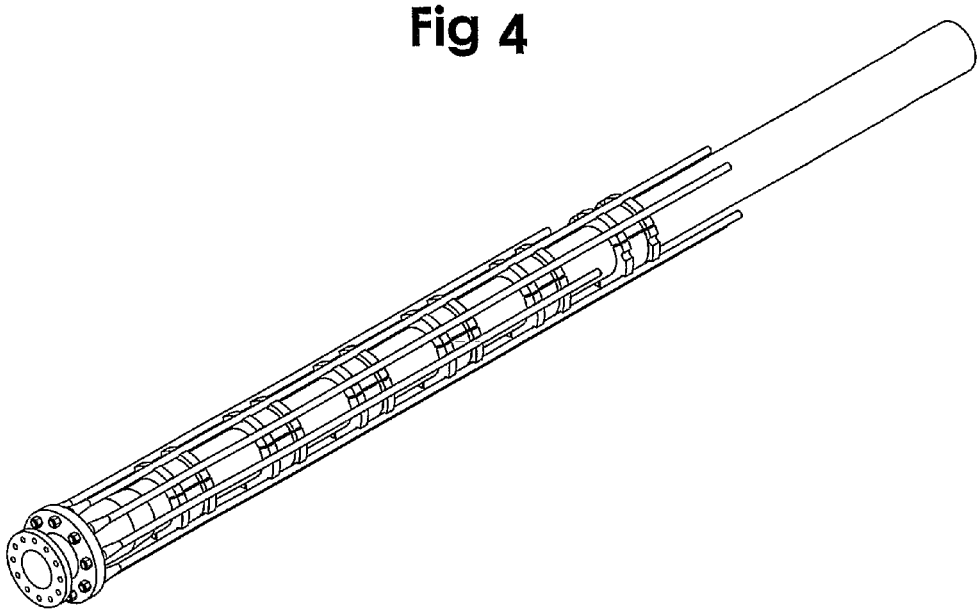
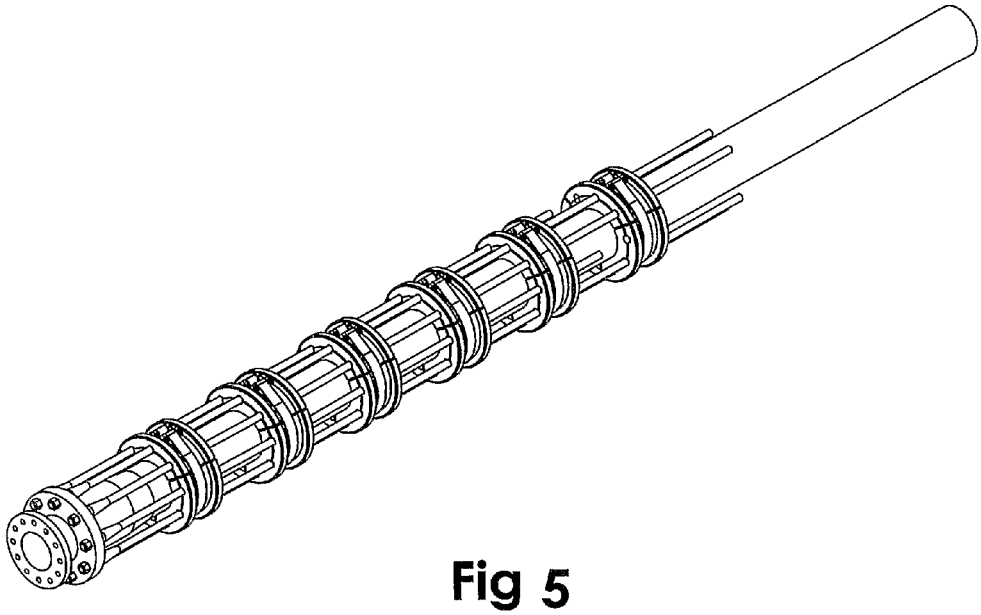
Fig 5

BEND STIFFENER

The invention relates to a bend stiffener which is configured to surrounds the end portion of an elongate, essentially cylindrical object, extending from a subsea installation to a surface vessel, and is connected to an end piece or end flange of the object at a connection to the vessel.

As examples of related art, reference can be made to U.S. Pat. Nos. 3,252,192, 5,161,828 and 5,439,323, of which the '828 patent seems to be closest to the invention. This document describes a structure for stiffening a connection under water. However, the stiffened elements are secured in fixed flanges on each respective coupling part, and this structure does not have any clamps as in the invention.

Today, in offshore petroleum production at great ocean depths, flexible pipes and cables/umbilical lines, generally referred to respectively as risers and umbilicals, are often used for transport of liquids and gas and for energy supply and signal transmission. Such flexible pipes and umbilicals typically connect a surface vessel such as an FPSO (Floating Production Storage Offloading), production platform, rig or buoy to wellheads or other installations on the seabed.

Because of the motions of the vessel and ocean currents, the pipes and umbilicals will be subjected to mechanical stresses which may result in fatigue fractures. It is especially the area in the immediate vicinity of the connection to the surface vessel that is the weak point. To avoid damage and failure of the connection, it is usual to install a bend stiffener immediately behind the connection point at the end of the pipe or umbilical. These bend stiffeners are traditionally constructed as a slightly conical, cylindrically shaped tube. The material as a rule is an elastic material such as polyurethane. Bend stiffeners of this type undoubtedly have limitations and disadvantages:

- The bend stiffener must be mounted on the pipe or umbilical before the end flange (end connector) can be mounted. This is a disadvantage both as regards logistics and transport.
- The pipe or umbilical must be cut if the bend stiffener has to be replaced. This involves extra work and substantial costs.
- A compact bend stiffener which surrounds a pipe carrying a liquid (oil) of high temperature will have a thermally insulating effect. This may result in local high temperatures which could be detrimental to both the materials of the pipe and the materials of the bend stiffener itself.

The object of the invention is to remedy the problems of the prior art, and this is achieved with a bend stiffener of the type mentioned above which is characterised in that the bend stiffener is provided by a plurality of inner, essentially cylindrical clamps made having longitudinal grooves for receiving spring rods in their outer surface, which clamps surround the object, and there is provided a plurality of outer, essentially cylindrical clamps which in their inner surface are made having longitudinal grooves for receiving the spring rods, the grooves in the inner and the outer clamps corresponding to each other when the outer clamp is mounted around the inner clamp, and a plurality of clamp sets are arranged spaced apart from each other in vicinity of the end piece, the spring rods being secured in the end piece or end flange of the pipe, or an adapted arrangement on the object, and extending longitudinally along the object, through the grooves in the inner and outer clamps, and the outer clamps are secured to the inner clamps and lock the spring rods relative to the inner clamps and the object.

Advantageous embodiments of the invention are disclosed in the dependent claims.

In the bend stiffener according to the invention, elastic spring rods of a suitable material such as titanium or fibre-reinforced plastic are used. This gives the following advantages:

- The bend stiffener can be mounted after the end flange (end connector) has been mounted.
- It is possible to remove the bend stiffener or replace components thereof without having to cut the pipe or the umbilical.
- The bend stiffener will not form a thermally insulating sheath around the pipe.
- The stiffness or characteristic of the bend- stiffener can be adjusted by altering the number of spring rods, the diameter of the rods, the material or the length of the rods.

The invention will now be described with reference to the drawings, wherein:

FIGS. 2-5 are perspective views of, respectively, an inner clamp, an outer clamp, spring rods arranged on inner clamps which surround a flexible pipe and the bend stiffener fully mounted with the aid of the outer clamps.

Figure 1:
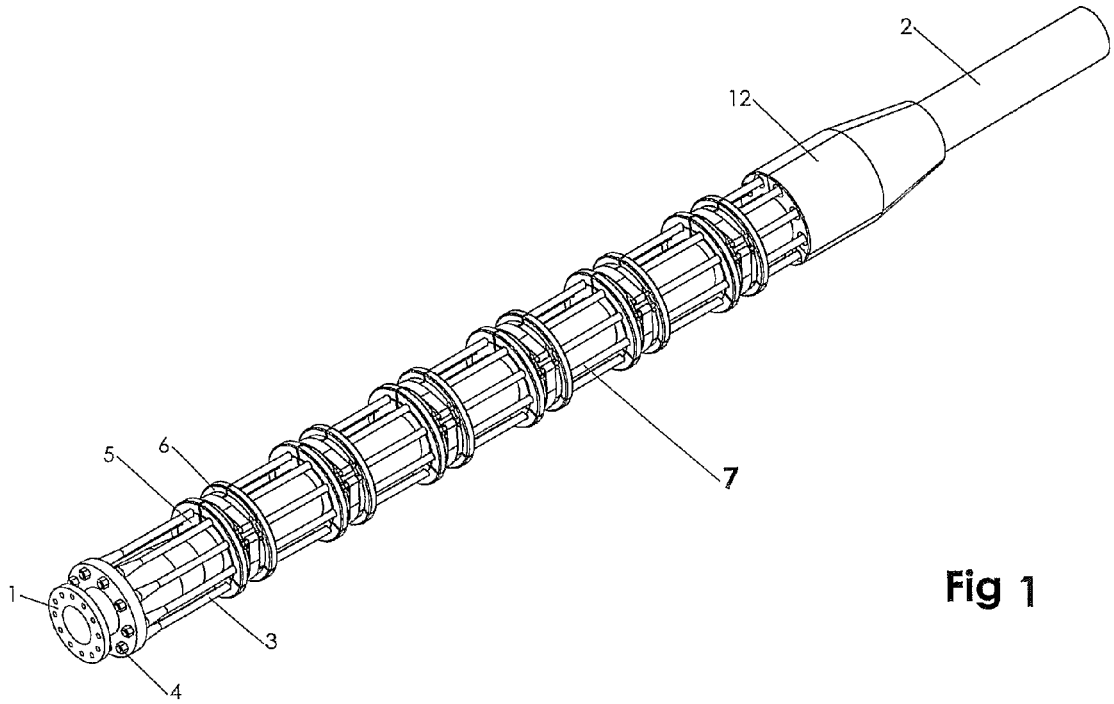
FIG. 1 is a perspective view of a bend stiffener according to the invention mounted on a flexible pipe.

Although the exemplary embodiment of the invention refers to a bend stiffener for a flexible pipe, the concept for an umbilical will basically be identical, except that the connector at the end (the end flange) will be different.

In FIG. 1 the reference numeral 1 indicates an end piece or end flange of a flexible pipe 2, for example, a riser. The reference numeral 3 indicates a spring rod, 4 a fastening of the spring rods 3, 5 an inner clamp, 6 an outer clamp, 7 the bend stiffener itself and 12 a rear section or end cone. FIGS. 2 and 3 indicate respectively the outer grooves 8 for the spring rods on the inner clamp 5 and inner grooves 8 for the spring rods 3 on the outer clamp 6.

When providing a bend stiffener 7, an end piece 1 must be mounted on a pipe 2 that is to be protected by the bend stiffener 7. The end piece 1 is fastened to the pipe 2 in a conventional manner. A rear section or end cone 12 is mounted on the pipe 2, preferably at a distance from the end piece 1. This rear section 12 may consist of cone segments which, in a cylindrical edge area facing the end piece 1, are provided with openings to receive/surround the end portions of spring rods 3 which project beyond the mounting clamps 5 and 6 of the bend stiffener 7 on the pipe 2 that are furthest from the end piece 1. The rear section thus functions primarily as a guard or shield for these end portions so that they do not protrude and potentially cause problems in that rope or other items become caught or that the ends of the rods 3 hit and damage other objects such as other pipes or the like, but it also gives the bend stiffener 7 a more streamlined termination. An integral fastening 4 for the spring rods 3 is provided in the end piece 1. The spring rods are preferably round rods made of titanium or fibre-reinforced plastic such as carbon fibre or glass fibre reinforced plastic, or another suitable material or alloy. The fastening 4 may be provided by providing holes in the end piece 1 for receiving the spring rods 3 that may be formed having a conical portion which rests against the end piece 1 and a threaded portion that is arranged through the holes so that the threads can engage with locking nuts, indicated by the reference numeral 4. If fibre-reinforced plastic or the like is used for the spring rods 3, it may be expedient to provide the rod ends with a steel sleeve or the like to be able to provide the desired fastening to the end piece 1. A plurality of essentially cylindrical inner clamps 5 with outer longitudinal grooves 8 for receiving spring rods 3 are placed around the pipe 2. Over these inner clamps are likewise arranged essentially cylindrical outer clamps 6 with corresponding inner longitudinal grooves 8 for receiving spring rods 3. The clamps 5 and 6 may be produced of any suitable material, and consist preferably of two or more segments that are assembled so as to provide the cylindrical shape. The inner clamps 5 are installed first. After they have been installed, the spring rods 3 are mounted. The outer clamps 6 are secured on the outside of the inner clamps 5, which locks the spring rods 3 relative to the inner clamps 5 and the pipe 2. The outer clamps 6 are provided with a suitable retaining device, in FIG. 3 indicated as a retaining band 11, so that they are held securely fastened in place.

When the pipe 2 bends with the bend stiffener 7, the spring rods 3 will slide axially relative to the clamps 5 and 6. To ensure minimal frictional force between the spring rods 3 and the clamps 5 and 6, liners of a suitable material may be used (not shown) which are mounted between the clamps 5 and 6 and the spring rods 3.

The stiffness of the bend stiffener 7 can be adjusted by altering the number of spring rods 3. Furthermore, the diameter of the rods 3, materials selection and the length of the rods 3 will be of importance. Similarly, the longitudinal distance between respective sets of clamps 5, 6 can be altered and the stiffness can also be decreased, for example, towards the end of the bend stiffener 7 by having some rods shorter than others. The characteristic or stiffness of the bend stiffener 7 can also be affected by using rods 3 of different materials in the same unit.

It may be desirable to monitor motions and angular displacement of the bend stiffener 7. This can, for example, be used to obtain an indication of the pipes 2 (or cables) themselves, to estimate or predict service life of the bend stiffener 7 and to register extreme loads such as accident loads. For monitoring of this kind, it is necessary to mount sensors on some of the spring rods 3. Strain gauges could be used on spring rods 3 of metal, whilst fibre optic elements that are integral with the actual spring rods 3 could be used on spring rods 3 of fibre-reinforced plastic or composite material. Signals from the sensors are sent to the surface vessel via telemetry cables.

The bend stiffener 7 according to the invention can be provided in any suitable length, but the spring rods 3 typically have a length in the range of 4 to 10 meters. The clamps 5 and 6 can be provided in any suitable material, in different dimensions depending on the diameter of the object they are to surround, and the number of rods that are used can also be chosen as required.

The invention claimed is:

1. A bend stiffener which is configured to surround the end portion of an elongate, essentially cylindrical object, extending from a subsea installation to a surface vessel, and is connected to an end piece or end flange of the object at a connection to the vessel, characterized in that the bend stiffener is provided by a plurality of inner, essentially cylindrical clamps made having a longitudinal groove for receiving spring rods in their outer surface, which clamps surround the object, and there is provided a plurality of outer, essentially cylindrical clamps which in their inner surface are made having longitudinal grooves for receiving the spring rods, the grooves in the inner and outer clamps corresponding to each other when the outer clamp is mounted around the inner clamp, and a plurality of clamp sets are arranged spaced apart from each other in vicinity of the end piece or end flange, the spring rods being secured in the end piece or the end flange of the object, or an adapted arrangement on the object, and extending longitudinally along the object, through the grooves in the inner and outer clamps, and the outer clamps are secured to the inner clamps and lock the spring rods relative to the inner clamps and the object.

2. bend stiffener as disclosed in claim 1, characterized in that the spring rods are made of an elastic material of a suitable metal, metal alloy, or a composite material or fibre-reinforced plastic.

3. A bend stiffener as disclosed in claim 2, characterized in that the metal is titanium, or that the material is a carbon fibre or glass fibre reinforced plastic.

4. A bend stiffener as disclosed in claim 1, characterized in that at a distance from the end piece or end flange there is provided a rear section or end cone which surrounds the object, which rear section or end cone in a cylindrical edge area facing the end piece or end flange is provided with openings for receiving the end portions of freely projecting spring rods.

5. A bend stiffener as disclosed in claim 4, characterized in that the rear section or end cone consists of segments.

6. A bend stiffener as disclosed in claim 1, characterized in the inner and/or the outer clamp being provided by segments which are assembled so as to surround the object.

7. A bend stiffener as disclosed in claim 1, characterized in that sensors are provided on one or more of the spring rods to monitor motions and angular displacement of the bend stiffener.

8. A bend stiffener as disclosed in claim 1, characterized in that the outer clamp is secured by a suitable retaining device.

9. A bend stiffener as disclosed in claim 8, characterized in that the sensor is a strain gauge, or a fibre optic element that is integral with the spring rod itself.

10. A bend stiffener as disclosed in claim 8, characterized in that the retaining device is a retaining band or locking band.

11. A bend stiffener as disclosed in claim 1, characterized in that the spring rods have the same or different lengths, and/or that the same or different materials are used in the spring rods in one and the same bend stiffener.

12. A bend stiffener as disclosed in claim 1, characterized in that it is configured to surround an object in the form of a flexible pipe or a cable.

* * * * *

UNITED STATES PATENT AND TRADEMARK OFFICE

CERTIFICATE OF CORRECTION

PATENT NO. : 7,568,861 B2
APPLICATION NO. : 11/575532
DATED : August 4, 2009
INVENTOR(S) : Godøy et al.

It is certified that error appears in the above-identified patent and that said Letters Patent is hereby corrected as shown below:

ON THE FACE PAGE

On the Face Page, in Field (57), under "ABSTRACT", in Column 2, Line 2, delete "e.g." and insert -- e.g., --, therefor.

IN THE CLAIMS

In Column 4, Line 16, in Claim 2, before "bend", insert -- A --.

Signed and Sealed this

Fourth Day of May, 2010

David J. Kappos

David J. Kappos
*Director of the United States Patent and Trademark Office*